US006033140A

United States Patent [19]

Peng Huang

[11] Patent Number: 6,033,140

[45] Date of Patent: Mar. 7, 2000

[54] LIPSTICK STRUCTURE

[76] Inventor: Yin Tzu Peng Huang, Floor 6, No. 114, Sec. 2, Chung Shan N. Road, Taipei, Taiwan

[21] Appl. No.: 09/212,407

[22] Filed: Dec. 16, 1998

[51] Int. Cl.[7] ..... B43K 21/00

[52] U.S. Cl. ..... 401/83; 401/63; 401/74; 401/82; 401/86

[58] Field of Search ..... 401/61, 62, 63, 401/74, 82, 83, 84, 87, 117, DIG. 1, 55, 86

[56] References Cited

U.S. PATENT DOCUMENTS

| | | | |
|---|---|---|---|
| 2,317,087 | 4/1943 | Reutter | 401/82 |
| 2,332,147 | 10/1943 | Holihan | 401/74 |
| 5,746,530 | 5/1998 | Oota | 401/63 |

FOREIGN PATENT DOCUMENTS

| | | | |
|---|---|---|---|
| 65016 | 1/1950 | Netherlands | 401/86 |
| 671388 | 5/1952 | United Kingdom | 401/74 |

*Primary Examiner*—Henry J. Recla
*Assistant Examiner*—Khoa Huynh
*Attorney, Agent, or Firm*—Bacon & Thomas, PLLC

[57] ABSTRACT

A lipstick structure includes an elongated tubular body having a front open to receive therein a stick holder with a lipstick mounted thereon. A longitudinal slit is formed on the tubular body and extending from the front open end to a middle point of the tubular body along the length thereof and a longitudinal slot is also formed on the tubular body and extending from the terminated point of the slit toward the rear end of the tubular body, the slot having a width greater than that of said slit. An expanded hole is formed and connected between the slit and slot. The slot and hole are offset from the slit to define a step-like stop between the slit and the hole. A control tab is mounted to the stick holder by a support tab which is movable within the slit and the slot so as to allow the stick holder to be movable from the rear end of the tubular body to the middle point thereof to have a portion of the lipstick project out of the tubular body for service. A neck of the slot is formed by two opposite projections formed on the side edges thereof at the connection thereof with the hole so as to maintain the support rod within the hole by cooperating with the step-like stop.

5 Claims, 2 Drawing Sheets

LIPSTICK STRUCTURE

FIELD OF THE INVENTION

The present invention relates generally to a lipstick and in particular to an improved lipstick tube structure.

BACKGROUND OF THE INVENTION

The conventional lipsticks that are currently available in the market usually comprise a tube inside which a stick holder is movably received. A cap is provided for receiving therein and thus covering the tube and the stick disposed inside the tube. A lipstick is held on the stick holder and thus is movable relative to the tube so that a user may move the lipstick out of the tube for use.

The lipstick movement mechanism is generally comprised of helical thread means which is, in general, slightly complicated in structure and control and also expensive in manufacturing cost.

Further, due to the complication of the helical thread type movement mechanism, miniaturizing the overall size of the lipstick and reduction of the manufacturing cost are very difficult.

It is therefore desirable to provide a lipstick tube structure which adopts a simple movement mechanism without helical thread means to overcome the above-mentioned deficiencies.

SUMMARY OF THE INVENTION

According to an aspect of the present invention, there is provided a lipstick tube structure which comprises an elongated tubular body having a front open end and a rear end with a longitudinal slit formed thereon, extending from the front open end to a middle point of the elongated tubular body, for guiding the disposition of the stick holder, along with the lipstick mounted thereon, into the tubular body toward the rear end thereof.

According to another aspect of the present invention, the lipstick tube structure further comprises a longitudinal slot, having a width greater than that of the longitudinal slit and extending from the middle point of the tubular, where the longitudinal slit terminates, to the proximity of the rear end of the tubular body, an expanded hole being formed and connected between the longitudinal slit and the longitudinal slot, the expanded hole and longitudinal slot being offset relative to the longitudinal slit so as to define a step-like stop between the longitudinal slit and the offset expanded hole for maintaining the stick holder and the lipstick thereon within the tubular body.

According to a further aspect of the present invention, a control tab is mounted to the stick holder by a support rod which is receivable and movable within the longitudinal slit and the longitudinal slot to be located outside the tubular body for access by a user and by moving the control tab, the lipstick that is secured on the stick holder is moved from the rear end toward the middle point thereof and stopped by the step-like stop to allow a portion of the lipstick to project out of the front open end of the tubular body for service, a pair of side projections being provided on the side edges of the longitudinal slot at the connection thereof with the expanded hole which allows the support rod to pass in a forced manner so as to maintain the lipstick at the service position by holding the support rod in the expanded hole by the step-like stop and the side projections.

According to a further aspect of the present invention, the stick holder has a plurality of legs, preferably resilient, extending from a rear end thereof, each having a boss formed thereon facing outward and sideward and contacted by the inside surface of the tubular body so as to form point contacts between the stick holder and the inside surface of the tubular body to provide an easy movement of the stick holder relative to the tubular body.

According to a further aspect of the present invention, there is provided a structure-simplified lipstick tube which allows miniaturization of the overall size and reduction of the manufacturing cost of the lipstick tube structure, as compared to the conventional lipstick tube structure.

BRIEF DESCRIPTION OF THE DRAWINGS

The structural and operational characteristics of the present invention and advantages thereof, as compared to the known state of the art, will be better understood from the following description of a preferred embodiment of the present invention, with reference to the attached drawings, wherein.

DETAILED DESCRIPTION OF THE PREFERRED EMBODIMENT

Figure 1:
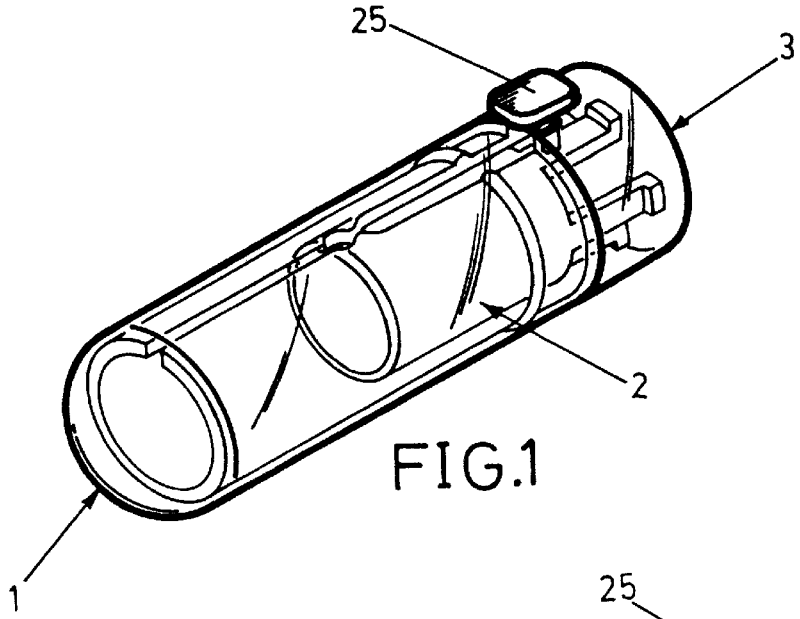
FIG. 1 is a perspective view showing a lipstick constructed in accordance with the present invention.
Figure 2:
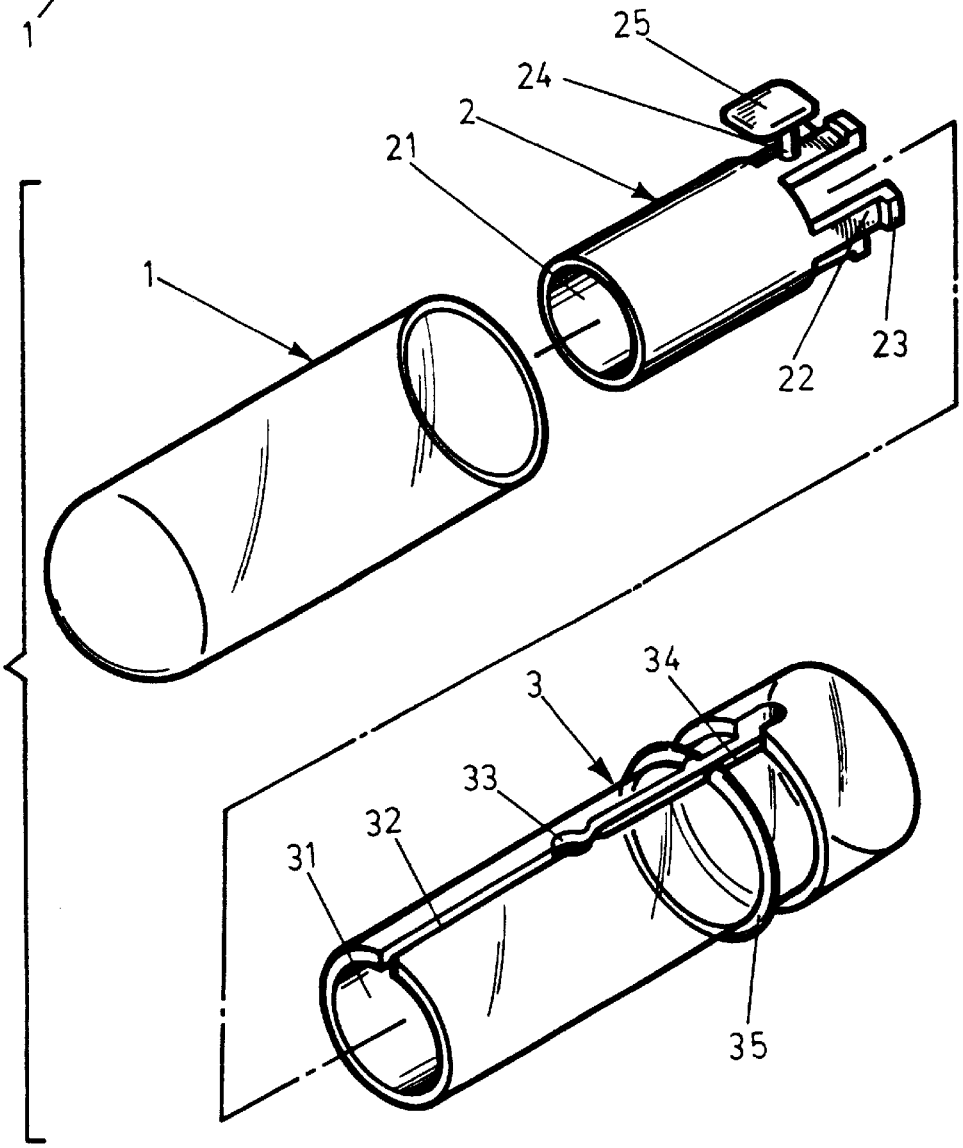
FIG. 2 is an exploded perspective view showing the lipstick structure of the present invention.
Figure 3:
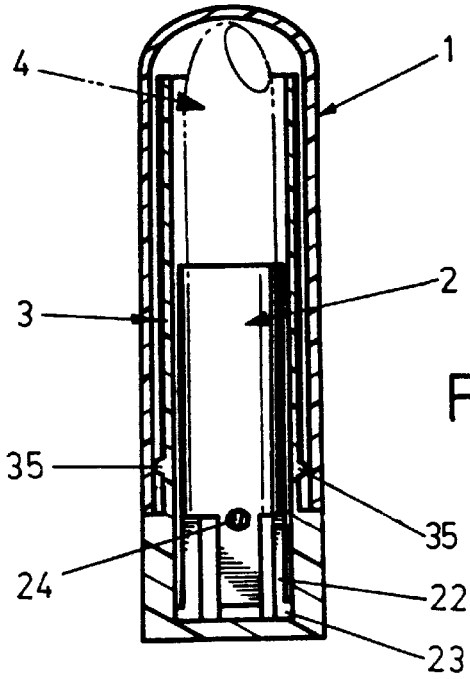
FIG. 3 is a cross-sectional view showing the lipstick structure of the present invention.

With reference to the drawings and in particular to FIGS. 1–3, wherein a lipstick made in accordance with the present invention is shown, the lipstick of the present invention comprises an elongated tubular body 3 having an open front end 31 and an opposite closed rear end. The tubular body 3 has a slit 32 formed on the outside surface thereof, extending from the front opening 31 to a middle point along the length thereof. A slot 34 is also formed on the outside surface of the tubular body 3 from the middle point where the slit 32 terminates to substantially close to the closed rear end of the tubular body 3. The slot 34 has a width greater than that of the slit 32 and is offset relative to the slit 32, as more clearly shown in FIG. 4.

Figure 4:
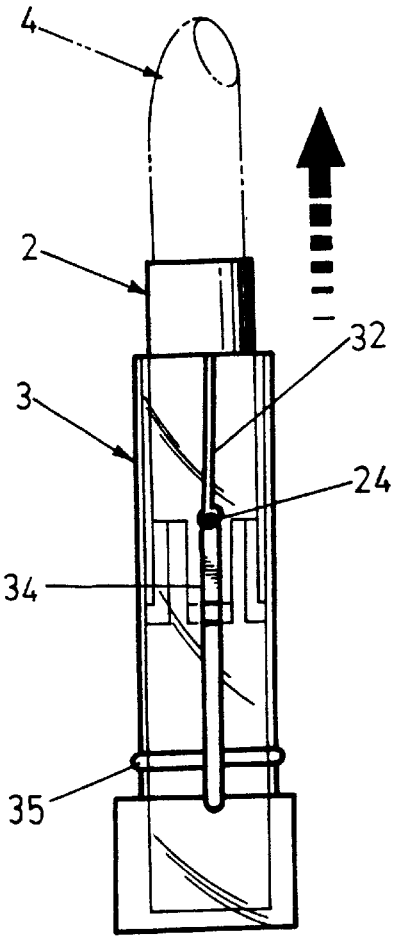
FIG. 4 is a side elevational view showing the operation of the lipstick of the present invention.
Figure 5:
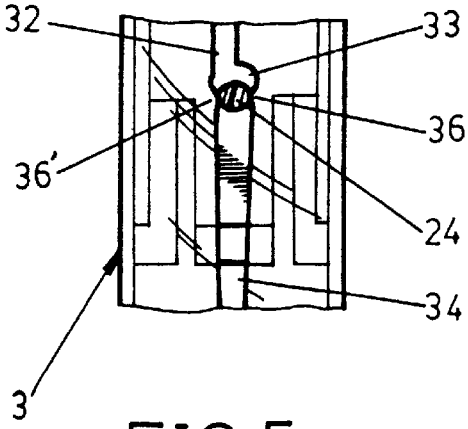
FIG. 5 is an enlarged view of a portion of the lipstick tube showing the structure of the expanded hole made in accordance with the present invention.

Between the slit 32 and the slot 34, an expanded hole 33 is formed on the tubular body 3 to connect the slit 32 to the slot 34, as shown in FIG. 4. The expanded hole 33 is offset from the slit 32 so as to define a step-like stop at the connection thereof with the slit 32.

At the connection between the hole 33 and the slot 34, a neck defined by two opposite side projections 36, 36' formed on the side edges of the slot 34 is provided. The function of the neck will be discussed hereinafter.

A stick holder 2 slidably received within the tubular body 3 comprises an elongated tubular member having a front opening 21 for receiving a lipstick 4 (see phantom line of FIGS. 3 and 4) therein. The stick holder 2 further has a rear end on which a plurality of legs 22 are formed as extensions thereof. Preferably, the legs 22 are resilient. Each of the legs 22 has a free end on which a boss 23 facing outward and sideward is formed so that when the stick holder 2 is received within the tubular body 3, the side bosses 23 of the legs 22 form point contacts with the inside surface of the tubular body 3 to allow the stick holder 2 to be more easily movable relative to the tubular body 3.

A control tab 25 is mounted to the stick holder 2 by a support rod 24 which is movably receivable within the slit 32 and the slot 34 of the tubular body 3 with the control tab 25 located outside the tubular body 3 so as to allow the stick holder 2 to be slidable relative to the tubular body 3 without being interfered by the control tab 25 and the support rod 24 thereof.

The control tab 25 provides means for a user to move the stick holder 2 relative to the tubular body 3 with the support rod 24 moving in the slit 32 and the slot 34. The stick holder 2 which is deposited into the tubular body 3 from the front opening 31 of the tubular body 3 is disposed toward the rear end of the tubular body 3 with the support rod 24 located within the slot 34. By moving the control tab 25 toward the middle point of the tubular body 3, the lipstick 4 which is secured on the stick holder 2 is moved toward the front opening 31 of the tubular body 3 to allow the stick 4 to be projected out of the front opening 31 of the tubular body 3 for service.

The movement of the stick holder 2 toward the front opening 31 of the tubular body 3 will be stopped by the step-like stop defined by the expanded hole 33 to maintain the stick holder 2 and the lipstick 4 within the tubular body 3. The neck defined by the projections 36 and 36' has such a dimension as to allow the,support rod 24 to pass under a forced condition so that once the control tab 25 is pushed toward the middle point of the tubular body 3 and having the support rod 24 forced to pass the neck to enter the expanded hole 33, the support rod 24 will be maintained therein to keep the lipstick 4 in its service position.

The lipstick tube structure of the present invention may also comprises a cap 1 also in the form of an elongated tubular member having an open end for receiving therein and thus covering a major portion of the tubular body 3 with only the closed rear end of the tubular body 3 exposed.

Preferably, a circumferential ring-like projection 35 is formed on the outside surface of the tubular body 3 at a location close to the rear end thereof so as to hold the cap 1 on the tubular body 3 by contacting friction thereof with the cap 1, as shown in FIG. 3.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A lipstick structure comprising:

an elongated tubular body having a front open end and an opposite rear end, a longitudinal slit formed on said tubular body and extending from the front open end to a middle point of said tubular body along the length thereof, a longitudinal slot formed on said tubular body and extending from the middle point where said slit terminates toward the rear end of said tubular body, said slot having a width greater than that of said slit, an expanded hole being formed and connected between said slit and said slot, said slot and hole being offset from said slit so as to define a step-like stop between said slit and said hole;

a stick holder in the form of an elongated tubular member having a front opening for receiving and holding therein a lipstick and an opposite rear end and movably received within said tubular body from the front open end of said tubular body to be disposed toward the rear end of said tubular body; and a control tab which is mounted to said stick holder by a support rod which is receivable and movable within said slit and said slot to allow said stick holder to be disposed toward the rear end of said tubular body, said control tab being located outside said tubular body for user's access so that by pushing said control tab toward the middle point of said tubular body from the rear end of said tubular body, said stick holder is moved toward the front open end of said tubular body to have the lipstick located at a service position thereof where a portion of the lipstick project out of said tubular body from the front open end thereof for service, the movement of said stick holder being stopped by having the support rod enter said expanded hole and stopped by the step-like stop to maintain the lipstick on its service position.

2. A lipstick structure as claimed in claim 1, further comprising a cap having an opening for receiving therein and thus covering at least a portion of said tubular body, together with said stick holder and the lipstick received within said tubular body.

3. A lipstick structure as claimed in claim 2, wherein said tubular body has a circumferential ring-like projection formed thereon to be contacted by an inside surface of said cap for holding said cap on said tubular body.

4. A lipstick structure as claimed in claim 1, wherein said stick holder comprises a plurality of legs extending from the rear end thereof, each having a free end distant from the rear end of said stick holder with a boss facing outward and sideward formed thereon to contact an inside surface of said tubular body so as to form point contacts between said stick holder and said tubular body to provide an easy movement of said stick holder relative to said tubular body.

5. A lipstick structure as claimed in claim 1, wherein said longitudinal slot comprises a pair of opposite projections respectively formed on a side edge of said slot at the connection thereof with said expanded hole to define a neck of said slot which allows the support rod of said control tab to pass under a forced condition so that when said control tab is pushed toward the middle point of said tubular body to force the support rod to pass the neck and enter said expanded hole, said support rod is held within said expanded hole to maintain the lipstick on its service position.

* * * * *